US006752917B2

(12) United States Patent
Bulan et al.

(10) Patent No.: US 6,752,917 B2
(45) Date of Patent: Jun. 22, 2004

(54) PROCESS FOR PREPARING PERFLUORINATED ORGANIC COMPOUNDS BY ELECTROCHEMICAL FLUORINATION

(75) Inventors: Andreas Bulan, Langenfeld (DE); Joachim Herzig, Leichlingen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/887,617

(22) Filed: Jun. 22, 2001

(65) Prior Publication Data

US 2002/0000384 A1 Jan. 3, 2002

(30) Foreign Application Priority Data

Jun. 28, 2000 (DE) ..... 100 31 563

(51) Int. Cl.[7] ..... C25B 3/08; C25B 3/00

(52) U.S. Cl. ..... 205/430; 205/422; 205/445; 205/460

(58) Field of Search ..... 205/413, 422, 205/430, 431, 436, 460, 445

(56) References Cited

U.S. PATENT DOCUMENTS

| | | | | |
|---|---|---|---|---|
| 2,519,983 A | | 8/1950 | Simons | 204/62 |
| 4,668,497 A | | 5/1987 | Miki | 423/484 |
| 4,756,899 A | | 7/1988 | Jenczewski et al. | 423/483 |
| 4,929,435 A | | 5/1990 | Boghean et al. | 423/484 |
| 5,326,437 A | | 7/1994 | Bulan et al. | 204/59 F |
| 5,366,597 A | * | 11/1994 | Bulan et al. | 204/59 F |
| 6,264,818 B1 | * | 7/2001 | Heider et al. | 205/430 |

FOREIGN PATENT DOCUMENTS

DE 2725211 A * 12/1978

OTHER PUBLICATIONS

Chem–Ing–Tech. 58 (month unavailable) 1986, Nr. 1 pp. 31–38, Enno Hollitzer und Peter Sartori, Die electrochemische–Fluorierung–ein Überblick.

Houben Weyl, vol. 10a, Organo Fluorine Compounds, (month unavailable) 1999, Chapter 7, pp. 305–320, Electrochemical Introduction of Fluorine, K. Pohmer and A. Bulan.

* cited by examiner

*Primary Examiner*—Edna Wong
(74) *Attorney, Agent, or Firm*—Godfried R. Akorli; Diderico van Eyl

(57) ABSTRACT

A novel process for the continuous preparation of perfluorinated organic compounds by electrochemical fluorination of the parent non-fluorinated or partially fluorinated organic compounds, in which the quantity of charge which the electrolyte can still take up is kept in the range from about 5 Ah per kg of electrolyte to about 600 Ah per kg of electrolyte during the electrochemical fluorination, can be operated continuously over a prolonged period of time without the electrode area-time yield decreasing over time and without the formation of polymeric by products occurring.

5 Claims, No Drawings

PROCESS FOR PREPARING PERFLUORINATED ORGANIC COMPOUNDS BY ELECTROCHEMICAL FLUORINATION

BACKGROUND

The invention relates to a process for preparing perfluorinated organic compounds by electrochemical fluorination.

Electrochemical fluorination is an electrochemical process known per se for introducing fluorine into organic compounds by reaction of the organic compounds with hydrogen fluoride. In principle, all hydrogen atoms of the organic compounds can be replaced by fluorine atoms during the course of the reaction, giving perfluorinated compounds. Partially fluorinated compounds or their downstream products and also short-chain cracking products and polymeric compounds can be formed as by-products. Compared with fluorination using elemental fluorine, electrochemical fluorination offers the advantage that functional groups of the starting compounds are retained unchanged. Depending on the length of the carbon chain of the starting materials, the yields of perfluorinated product are from 5 to 90% by weight, with the yields decreasing with longer carbon chains.

A review of electrochemical fluorination is given in E. Hollitzer P. Sartori, Chem.-Ing.-Tech. 58 (1986), No. 1, pp. 31–38 and Houben Weyl, Vol. 10a, Organo Fluorine Compounds (1999), Chapter 7, Electrochemical Introduction of Fluorine, pp. 305–318.

Since the space-time yields in electrochemical fluorination are low, it is known from the prior art that it can be advantageous to carry out electrochemical fluorination continuously.

When this process is carried out according to the abovementioned prior art, the following disadvantages are noticeable. For instance, in the industrial, continuous preparation of, perfluorobutylsulfonyl fluoride by electrochemical fluorination of sulfolane, sulfolene, butylsulfonyl fluoride or butylsulfonyl chloride or mixtures thereof, the yield decreases over time and after the electrolysis has been running for about six months, the electrolysis cell has to be switched off. Undesirable by-products such as perfluorosulfolane or polymeric compounds are formed over time. If relatively high concentrations of starting material in the hydrogen fluoride are chosen, this effect is observed earlier. The polymeric compounds are usually insoluble in the electrolyte and precipitate. The precipitated solid blocks the spaces between the electrodes, as a result of which the usable anode surface area is reduced and the electrode area-time yield drops. Here, "electrode area-time yield" is the amount of perfluorinated target product per unit electrode area and per unit of time. To increase the electrode area-time yield again, the electrode pack has to be removed and cleaned. The removal and cleaning of the electrode pack is very time-consuming, and the production downtime is correspondingly high. A large part of the electrolyte is unusable and has to be replaced. Its destruction incurs additional undesirable costs.

It is therefore an object of the invention to provide a process for preparing perfluorinated organic compounds which can be operated continuously over a prolonged period of time and in which the electrode area-time yield does not decrease with time and the formation of polymeric by-products is reduced.

SUMMARY

The process relates to a process for the continuous preparation of perfluorinated organic compounds by electrochemical fluorination of the parent non-fluorinated or partially fluorinated organic compounds using hydrogen fluoride, as an electrolyte, wherein the quantity of charge which the electrolyte can still take up is kept in the range from about 5 Ah per kg of electrolyte to about 600 Ah per kg of electrolyte during the electrochemical fluorination. These and other features, aspects, and advantages of the present invention will become better understood with reference to the following description and appended claims.

DESCRIPTION

The present invention provides an improved process for the continuous preparation of perfluorinated organic compounds by electrochemical fluorination of the parent non-fluorinated or partially fluorinated organic compounds (hereinafter referred to as starting materials) using hydrogen fluoride, as an electrolyte, wherein the quantity of charge which the electrolyte can still take up is kept in the range from about 5 Ah per kg of electrolyte to about 600 Ah per kg of electrolyte, preferably from about 50 to about 200 Ah per kg of electrolyte, during the electrochemical fluorination.

Commercial hydrogen fluoride can be used in the process of the invention. Preference is given to using hydrogen fluoride having a water content of less than about 300 ppm, a sulfuric acid content of less than about 300 ppm, a sulfur dioxide content of less than about 30 ppm and an arsenic content of less than about 30 ppm. It has been found to be particularly advantageous to use hydrogen fluoride having an arsenic content of less than about <10 ppm.

This low-arsenic hydrogen fluoride can be prepared by using particularly low-arsenic fluorspar in the preparation of hydrogen fluoride or by fractional distillation of commercial hydrogen fluoride to give a fraction rich in arsenic and a fraction low in arsenic.

This hydrogen fluoride is preferably prepared by oxidizing the arsenic compounds present in commercial hydrogen fluoride and isolating particularly low-arsenic hydrogen fluoride at the top in a distillation. As oxidizing agents, it is possible to use fluorine or hydrogen peroxide as described in U.S. Pat. No. 4,668,497 (cf. WO 88/06139).

In the process of the present invention, the formation of undesirable by-products and polymeric compounds is significantly reduced and, as a result, the perfluorinated organic compounds can be prepared in a constant, high electrode area-time yield.

For the purposes of the present invention, perfluorinated organic compounds are preferably perfluoroalkylsulfonyl fluorides of the general formula $C_nF_{2n+1}SO_2F$ ($n \geqq 3$), e.g., perfluorobutylsulfonyl fluoride, perfluoro-alkanes of the general formula $C_nF_{2n+2}$ (where n is 1 to 10) or perfluoroalkylamines of the general formula $(C_nF_{2n+1})_3N$ (where n is 1 to 10).

The process of the invention is preferably employed for preparing perfluorobutylsulfonyl fluoride using sulfolane, sulfolene, butylsulfonyl fluoride, butylsulfonyl chloride or mixtures thereof as starting material.

The electrolysis is carried out in hydrogen fluoride to which electrolyte salts such as sodium fluoride or sodium tetrafluoroborate (cf. U.S. Pat. No. 5,326,437) can be added. The electrode materials used for the anodes are usually nickel, and for the cathodes is nickel or iron.

The process of the invention can be carried out in cells having a capacity of up to about 4 $m^3$. The electrolyte can be circulated by pumping and cooled in order to minimize the hydrogen fluoride loss caused by evaporation. When the process of the invention is carried out industrially, the material to be fluorinated (starting material) is added continuously to the cell. The hydrogen fluoride that has been consumed can be added continuously or discontinuously during the course of the fluorination. The perfluorinated product can, if it has a boiling point of greater than about 20° C. and is insoluble in the electrolyte, be removed discontinuously or continuously from the cell. Extraction of the perfluorinated product from the electrolyte is appropriate when the perfluorinated product has a boiling point lower than about 20° C. or is readily soluble in the electrolyte. The amount of starting material added is calculated according to the equivalent of charge according to the stoichiometry of the reaction. When carrying out the process of the invention, the quantity of charge which the electrolyte can still take up can deviate from the desired value of from about 5 to about 600 Ah per kg of electrolyte in the initial phase at the beginning of the electrolysis. The electrolysis can be commenced at any starting concentrations of hydrogen fluoride and starting material. The electrolysis is preferably commenced using an electrolyte comprising 98% by weight of hydrogen fluoride and 2% by weight of starting material, in particular 95% by weight of hydrogen fluoride and 5% by weight of starting material. However, it is also possible to use an electrolyte containing, for example, 50% by weight of starting material and 50% by weight of hydrogen fluoride, but the amount of starting material is preferably kept as low as possible.

To carry out the process of the invention, it is necessary for the electrolyte to reach a state in which the quantity of charge which the electrolyte can still take up corresponds to the desired value of from about 5 to about 600 Ah per kg of electrolyte as quickly as possible after commencement of the electrolysis. If, for example, the electrolysis is commenced using an electrolyte comprising 50 parts by weight of hydrogen fluoride and 50 parts by weight of starting material, the quantity of charge which can still be introduced into the electrolyte should be brought to the desired value within the first weeks of the electrolysis. This can be achieved, for example, by appropriate reduced addition of the starting material.

The starting material can be added either steadily (continuously) or discontinuously, e.g., for periods at a time, so that the quantity of charge which the electrolyte can still take up can be maintained in the range from about 5 to about 600 Ah per kg of electrolyte, preferably from about 50 to about 200 Ah per kg of electrolyte. During these periods of addition, the starting material can be metered in continuously or in portions and stoichiometrically according to the reaction equation. The lengths of the periods of addition can be varied by altering the amount added during the period.

To monitor the quantity of charge which the electrolyte can still take up, the following procedure can be employed: At appropriate intervals (e.g., monthly), a sample of electrolyte is taken from the cell. The sample is electrolyzed in a laboratory cell under the conditions of the electrochemical fluorination without starting material being added. To avoid explosions in the gas space, the gas space of the cell is flushed with sufficient nitrogen for a hydrogen concentration of less than about 2% by volume to be achieved. The off-gas from the cell is analyzed for oxidizing constituents at regular intervals. This can be carried out, for example, by passing the off-gas through a starch solution containing potassium iodide. When the first oxidizing compounds are detected in the off-gas, the electrolysis is stopped and the quantity of charge is determined. The quantity of charge per kg of electrolyte which the electrolyte can still take up without the hydrogen fluoride being converted electrochemically into hydrogen and fluorine is calculated on the basis of the weight of electrolyte and the quantity of charge is determined. If this result indicates that the quantity of charge which the electrolyte can still take up lies outside the range specified according to the invention, the addition of starting material has to be increased or reduced until the values to be maintained according to the invention are achieved. The process of the invention ensures that a sufficiently high hydrogen fluoride concentration is always present in the electrolyte, the formation of by-products is largely avoided and high electrode area-time yields are achieved.

The electrolysis is generally carried out at current densities of from about 5 to about 40 mA/$cm^2$, preferably from about 8 to about 20 mA/$cm^2$. The voltage is generally from about 5 to about 10 volts, preferably from about 5 to about 7 volts. The temperature should be from 0 to about 20° C. preferably from about 10 to about 15° C.

The pressure under which the reaction is carried out is usually at ambient pressure of about 1 bar.

In principle, any electrochemical fluorination cell known from the prior art is suitable for the process of the invention. Examples of suitable electrochemical fluorination cells may be found, for example, in U.S. Pat. No. 2,519,983. An industrial electrolysis cell suitable for the process of the invention preferably has a volume of from about 2 to about 4 $m^3$.

The invention is further described in the following illustrative examples in which all parts and percentages are by weight unless otherwise indicated.

EXAMPLES

Example 1

Prior Art

Hydrogen fluoride was placed in an electrolysis cell having a volume of 2 $m^3$ and an anode area of 80 $m^2$, and 2% by weight of sulfolane were added. The electrochemical fluorination was commenced at a voltage of 7 V and a current density of 7.5 mA/$cm^2$. Sulfolane was metered in continuously and stoichiometrically. Hydrogen fluoride was added once per week. The perfluorobutylsulfonyl fluoride separated out from the electrolyte as a second phase and was taken from the cell weekly. After an operating time of about six months, the proportion of undesirable by-product (perfluorosulfolane) increased to over 5% by weight in the perfluorinated phase, and the yield of perfluorobutylsulfonyl fluoride dropped from an initial 45% to less than 30%. The hydrogen fluoride content of the electrolyte was less than 50% by weight. The cell was switched off, half the electrolyte was destroyed and the other half of the electrolyte was mixed again with hydrogen fluoride. The intermediate spaces of the electrodes and a large part of the electrolysis cell were fouled with polymeric product. After the electrode pack was cleaned, it was installed again and the electrochemical fluorination was recommenced. The new running time of the cell was again only about six months.

Example 2

Process in Accordance to the Invention

Hydrogen fluoride was placed in an electrolysis cell having a volume of 2 $m^3$ and an anode area of 80 $m^2$, and 2% by weight of sulfolane were added. The electrochemical fluorination was commenced at a voltage of 7 V and a current density of 7.5 mA/cm$^2$. When sulfolane was introduced, it was metered in continuously. Hydrogen fluoride was added once per week. The perfluorobutylsulfonyl fluoride separated out from the electrolyte as a second phase and was taken from the cell weekly. Every second week, a sample of the electrolyte was worked up in the laboratory, and the quantity of charge which the electrolyte could still take up was determined. The amount of starting material introduced was reduced until the electrolyte was able to take up a quantity of charge in the range from 100 to 150 Ah per kg of electrolyte. The cell was able to be operated for 1.5 years without the yield of perfluorobutylsulfonyl fluoride decreasing and without undesirable by-products or polymeric products being formed. Cleaning of the electrode pack and replacement or partial replacement of the electrolyte was not necessary.

Although the present invention has been described in detail with reference to certain preferred versions thereof, other variations are possible. Therefore, the spirit and scope of the appended claims should not be limited to the description of the versions contained therein.

What is claimed is:

1. A process for the continuous preparation of perfluorobutylsulfonyl fluoride from a starting material selected from the group consisting of sulfolane, sulfolene, butylsulfonyl fluoride, butylsulfonyl chloride, and mixtures thereof, the process comprising subjecting the starting material to electrochemical fluorination with an electrolyte comprising hydrogen fluoride, wherein the starting material is added continuously and the electrolyte has a quantity of charge that ranges from about 5 Ah per kg of electrolyte to about 600 Ah per kg of electrolyte and wherein the charge is maintained within the range during the continuous preparation of the perfluorobutylsulfonyl fluoride.

2. The process according to claim 1, wherein the quantity of charge is kept in the range from about 50 to about 200 Ah per kg of electrolyte.

3. The process according to claim 1, wherein the current density at which the electrolysis is carried out is from about 5 to about 40 mA/cm$^2$ and the voltage is from about 5 to about 10 volts.

4. The process according to claim 1, wherein the hydrogen fluoride used has an arsenic content of less than about 10 ppm.

5. A process for the continuous preparation of perfluorinated organic compounds comprising electrochemically fluorinating a non-fluorinated or a partially fluorinated organic compound with an electrolyte comprising hydrogen fluoride that has a quantity of charge that ranges from about 5 Ah per kg of electrolyte to about 600 Ah per kg of electrolyte and thereby continuously preparing the perfluorinated organic compounds wherein the charge is maintained within the range during the continuous preparation of the perfluorinated organic compounds wherein the hydrogen fluoride has a water content of less than about 300 ppm, a sulfuric acid content of less than about 300 ppm, a sulfur dioxide content of less than about 30 ppm and an arsenic content of less than about 30 ppm.

* * * * *